United States Patent [19]

Voslamber

[11] Patent Number: 4,501,216

[45] Date of Patent: Feb. 26, 1985

[54] SAIL AND RIGGING FOR A SAILING-APPARATUS

[76] Inventor: Bram J. Voslamber, Duinlustweg 21, 2243 GP Wassenaar, Netherlands

[21] Appl. No.: 451,365

[22] Filed: Dec. 20, 1982

[30] Foreign Application Priority Data

Jan. 6, 1982 [EP] European Pat. Off. ..... 82200007.1

[51] Int. Cl.[3] ..... B63H 9/04

[52] U.S. Cl. ..... 114/102; 114/39

[58] Field of Search ..... 114/39, 102, 103, 104, 114/105, 108, 39.2

[56] References Cited

U.S. PATENT DOCUMENTS

| | | | |
|---|---|---|---|
| 2,170,914 | 8/1939 | Rummler | 114/39 |
| 3,455,261 | 5/1968 | Perrin | 114/39 |

FOREIGN PATENT DOCUMENTS

| | | | |
|---|---|---|---|
| 94817 | 11/1923 | Austria | 114/39 |
| 2833616 | 2/1980 | Fed. Rep. of Germany | 114/39 |
| 7922941 | 9/1979 | France | 114/39 |

*Primary Examiner*—Trygve M. Blix

*Assistant Examiner*—Jesûs D. Sotelo

*Attorney, Agent, or Firm*—Nolte, Nolte and Hunter

[57] ABSTRACT

The sail is formed by a structure of stiffening elements comprising ribs r over which a sail-cloth zd is tightened to constitute a substantially stiff wing-like sail. The ribs r and girders l give the sail the correct profile and shape. The symmetrical sail is arranged to rotate and be mounted on top of the mast m on which it is able to hinge. The mast m is secured to the sailing-apparatus zt and able to hinge in one or more directions. The steering and control are done by exercising a moment around the centerpoint of the windforces by the sailor with the aid of handles or bows b. The mast m can be omitted and its functions fulfilled by the sailor, except when steering takes place with the aid of sheets. The sail can be composed of more than one profile and also be equipped with tails and fins. One variation has an adjustable angle between sail and mast m that can be locked in a chosen position. Another variation has a sail to mast connection sliding along the sail that can be locked in a chosen position.

7 Claims, 12 Drawing Figures

Figures 1A, 1B:
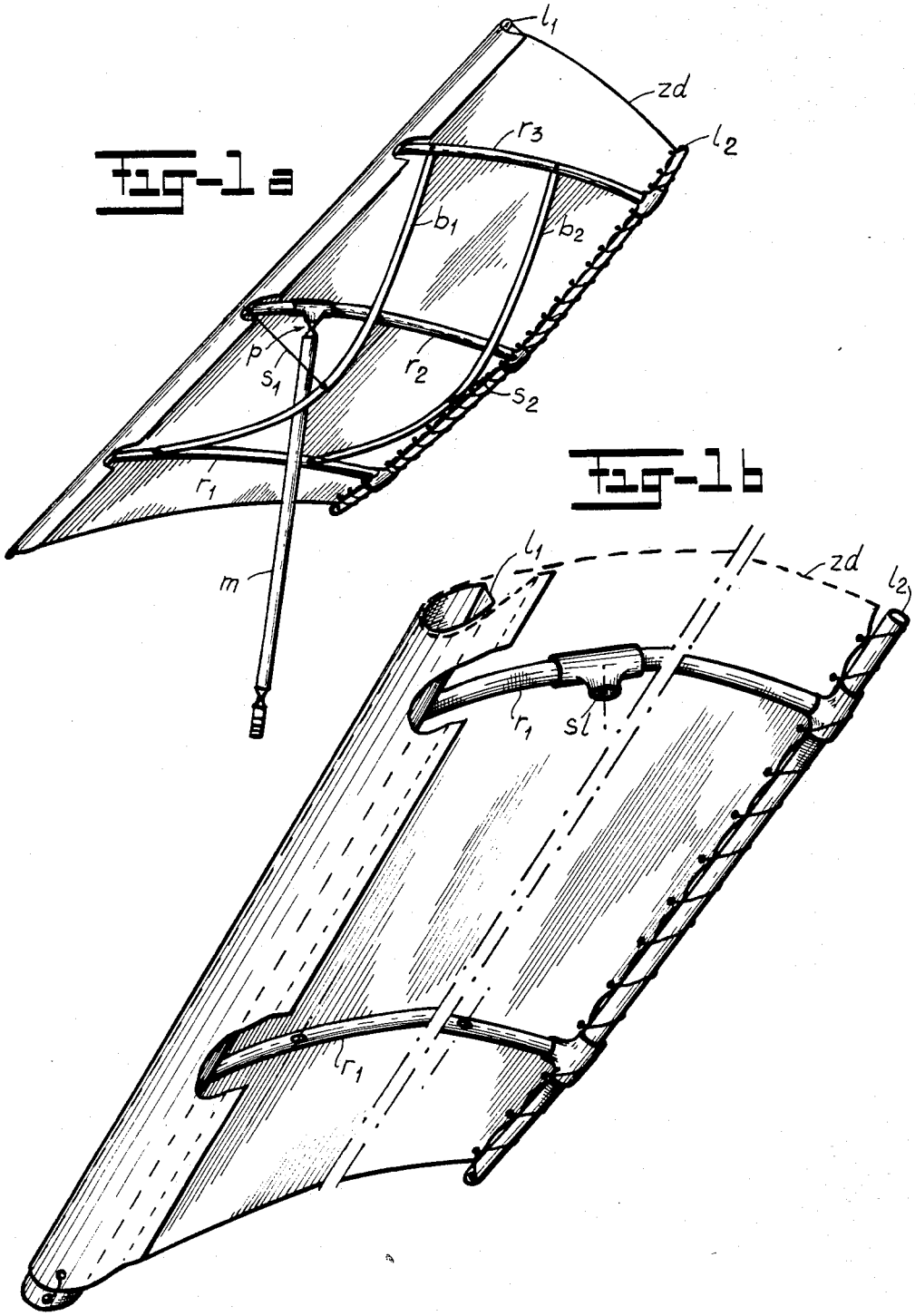

$l_1$
zd
$l_2$
$r_3$
$b_1$
$b_2$
p
$s_1$
$r_2$
$s_2$
$r_1$
m
$l_1$
zd
$l_2$
$r_1$
sl
$r_1$ $l_1$
zd
$b_1$
$l_2$
$b_2$
$r_1$
p
$s_1$
$r_2$
$s_2$
m
$r_3$
z
zt

I – I
II – II
III – III
IV – IV

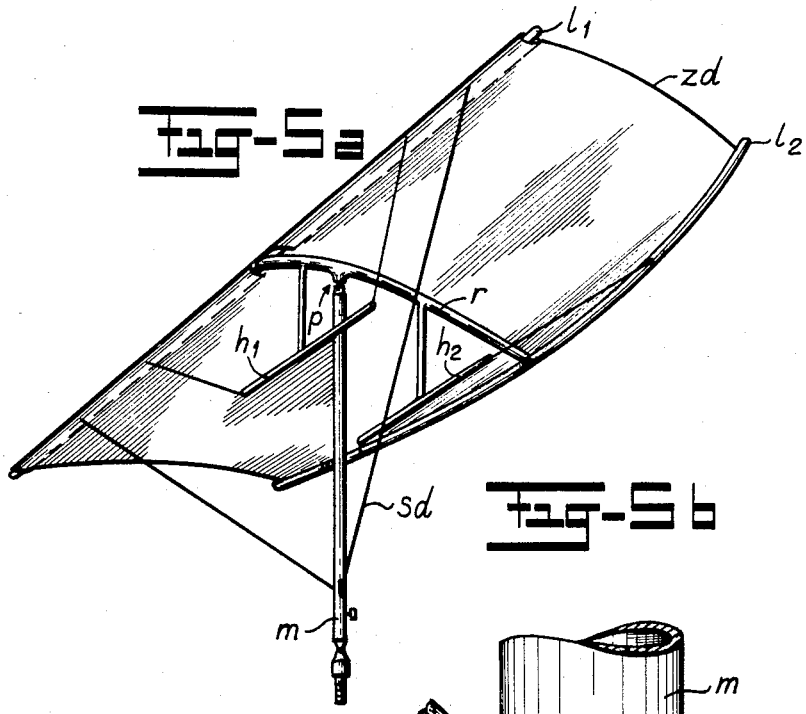
Fig-5a
Fig-5b
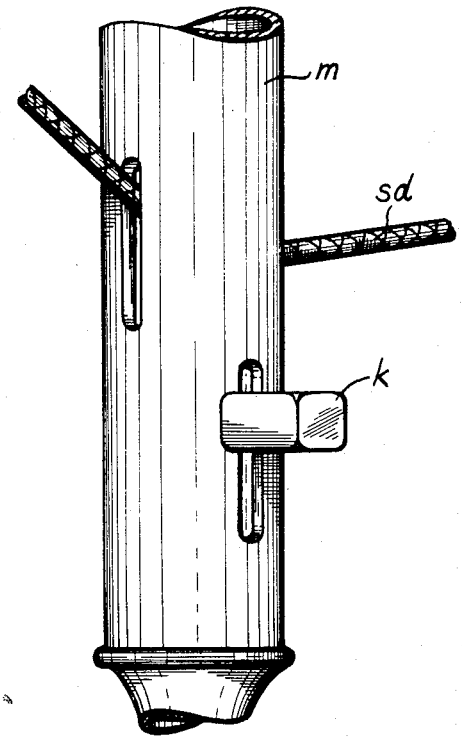

SAIL AND RIGGING FOR A SAILING-APPARATUS

The invention is concerned with a sail for propelling a sailing-apparatus over a surface, said sail having a frame, wherein a sailing-cloth is tightened over said frame and whereby the underside and the upperside act as windwardside respectively as leeside, and may be formed by separate cloths, wherein the sail is rotatable and hingeable with the aid of steering means in all directions with respect to a supporting body like a mast or so.

The classic sail has a fixed mast rigged on a sailing-apparatus. For the purpose of tightening and positioning the sail, usually stiffening means like for instance a boom, and sheets are being used.

A disadvantage of a fixed mast and a sail positioned with sheets is that when the ship lists under the influence of the wind, the sail moves to a different position, relative to the wind in the sense that the resultant of the windforces acting on the sail is not any more parallel to the surface of the water but has a downward component, or when an upward component was existing, this component is reduced.

When rigging a sailboard, the mast is placed with a flexible joint allowing it to hinge in all directions. The sailor must keep the mast in an upright position. A split boom is used to tighten the sail between the mast and the end of the split boom, at the same time it serves as a handle by which the sail is steered. Because of the O-shape of the split boom, room has been created for the sail to curve in the desired manner under the influence of the wind. Because of this rigging, it is possible to give the mast such an inclination that the wind exercises an upward directed force on the sail so that notably the sailboard experiences less resistance in the water.

To this method of rigging some drawbacks are attached:

To have the sail functioning optimally it is necessary for the wind to approach the sail over its maximum width. This means that the mast must be positioned rectangular to the wind-direction. This cannot always be achieved, a classic sailing-boat for instance looses this position when it starts leaning to the wind and a sailor would have to move his mast forward or backward which would also result in moving the reaction of the windpressure on the sail and hence would result simultaneously in luffing or falling. In fact steering of a sailboard is being done by moving the mast in one of these two directions.

By reducing the angle between the mast of a sailboard and the water-surface, measured in a plane perpendicular to the wind-direction, the vertical component increases and the horizontal component, responsible for the driving-force, decreases. The angle is determined by the sailer by less or more leaning overboard whereby he compensates with his own weight the moment exercised by the wind on the sail. The angle is therefore also determined by the strength of the wind and cannot be chosen independently.

When gybing or going about, the two sides of the sail change function and consequently the sail must be able to belly out in two directions, making it difficult to optimize the sail-profile and in fact virtually only single cloth profiles are being used.

For existing sailboards, going-about creates more problems than for an ordinary sailing-boat with a fixed mast and boom, because the sailor cannot duck in a simple manner under the sail; he has to walk around the mast or tilt the sail much forward and manipulate the sail over himself. In both cases the manoeuver requires time and skill.

Alternative rigging devices and sails have been proposed. U.S. Pat. No. 3,455,261 describes a "kite board" whereby the sail is replaced with a flat triangular kite-type sail with a T-shape frame connected to the sailing board, or not. The sail is held in position with ropes as is done usually with kites.

German Offenlegungsschrift No. 28 33 616 describes a rig for a sailboard with a triangular sail with booms in the two leading edges and a connecting framework.

French patent application No. 7922941 describes a triangular sail with a T-shape frame and a kind of mast with either an extremely forward or backward location.

A triangular sail with a strong V-shape of about 60° between the left wing and the right wing with a frame consisting of booms situated in the leading edges, a central boom and interconnecting framework has been published and demonstrated.

In all cases the triangular sail is held by its frame and finds a point of support and pivots on top of a mast, if any.

Above triangular sails may have improved going-about features, but lack properly curved and shaped sails and have insufficient steering facilities which becomes apparent later.

This invention provides for the ultimate sail and rigging to the extent that an optimum sail shape and profile is achieved resulting in the highest efficiencies possible yet stable and equipped with complete steering facilities enabling the sailor to direct and hold the sail in the position he wishes, rectangular to the wind, manoeuvering the sail for stability reasons without sacrificing the angle of inclination under which the sail provides the required lift and free to choose a ratio between the vertical and horizontal component.

The sail according to the invention is characterized in that said frame is formed with one or more ribs and girders, which together with the cloth(s) form a substantially stiff wing-type sail, in that the point of support coincides with or nearly with the point forming the design-pressure center of the windforces acting on the sail when sailing, and in that said steering means to be controlled by the sailor are formed by stiff bows and/or handles or the like, fitted to the frame and situated in a plane substantially parallel to the sail and distant from said point of support and said centerpoint of wind-pressure and distant at opposite sides of said points, whereby said points are arranged to be adjusted freely with respect to the sailing apparatus, for which purpose said supporting body like the mast or so is placed hingingly in at least one direction on said sailing-apparatus. A sail as described maintains the required aerodynamic wing-type profiles independent of the windforce, by means of a substantially stiff framework of ribs and girders and the cloth(s), in which the profiles and inclinations may change slightly towards the sail-ends and may have moderate V-shapes if any.

To achieve an acceptable shape and the required profiles, a minimum of two girders and one rib or one girder and two or more ribs are foreseen.

In principle, ribs and the sail can have any type of profile and varying from a single-cloth sail to a double-clothed profile. Also can be chosen a composite profile, composed of more than one profile, and for instance air-gaps. Various constructions of tails, fins and steering-areas can be added. The sail can be made symmetric with respect to the centre-rib. One or more ribs and girders give the sail its required stiffness. In case a mast is used, the sail will be secured to the top of the mast on or near the location of the design-pressure centre of the windforces acting on the sail, in such a manner that it can rotate and hinge in all directions. The point of rotation can be at any location between the sail and the sailing-apparatus.

The mast may be of a stiff construction for instance made of a stick or a hollow pipe, or for instance to able to absorb a pulling force only, when constructed like a chain, spring or rope, or for instance be able to withstand tension and some pressure forces, but is resilient to bending moments, for instance by having an elastic body around a limiting chain or rope-type construction and a series of hollow cylinders, thus allowing the mast to bend when loaded in that manner, so that injury and damage will be avoided. The mast may be of a telescoping structure with end stops, fixation means and be possibly preloaded by a spring or so. The bottom of the mast is placed on the deck for instance with a universal joint or for instance only hinging forward and backward if some steering limitations are wanted. If desired the mast may even be omitted and its functions taken over by the sailor.

The steering and directing of the sail can take place in various ways. For a sail of the dimensions of for instance a sailboard, direct steering can be done by the sailor with the aid of handles or bows or any device connected with the sail in such a manner that any moment can be executed around the pressure-centre of the wind-forces acting on the sail. Therefore handgrips or other means have a stiff connection with the sail and are located in a plane substantially parallel to the sail and distant from said point of support and said centerpoint of wind-pressure and distant at opposite sides of said points so that a moment in all planes perpendicular to the sail area can be executed without relocating hands. For larger sail-apparatus sheets can be used to position the mast and the sail.

The most important parameters for positioning the sail can now be set independently: By moving the mast backward and forward, luffing and falling can take place without changing the relative position of the sail to the wind, so that the sail will maintain the optimum position.

By rotating the sail around a vertical axis the correct position of the sail in relation to the wind direction can be found and the correct angle of inclination by rotation around an axis parallel to the sail.

By rotating the sail around an axis parallel to the wind direction, the horizontal and vertical components of the resultant of the windforces on the sail will change in opposite directions, so that an independent choice of the relative size of these components can be made.

By hinging the mast sideways, that is to port or starboard, while moving the sail parallel to the wind, a variation in the moment executed by the sail around the length-axis of the sailing-apparatus will result, so that the stability can be achieved independently of the aforementioned motions.

Warping of the sail can be counteracted by the sailor by placing the hands on the right location or with the use of bracing-wire. If desired, warping can be introduced in a similar manner.

Going about has been simplified with the introduction of this sail and rigging, the sailer tips the sail to the other side, the lower end becomes the higher end and vice versa, while the sailor hardly has to duck when passing the sail or moving the sail over his head.

As a consequence of the distribution of the windforces over the ribs and girders, these components can be made light, the mast is subjected only to tension and possibly some pressure and can thus be light. Convenient profiles can be chosen for the girders and the ribs, suitable for the expected windforces and required stability, and for instance to reduce the drag, to make posssible simple connections between the parts, to achieve the correct bending stiffness for the sail, to attain simple methods for assembling and for easy change of parts, etc. As material for these parts can be used for instance wood, metal, synthetic material or composite material.

By shortening the mast slightly under half the length of the sail, jamming of the sail on the sail-apparatus is avoided when for instance the sailor looses has control over the sailing-apparatus.

The hinging connection between the mast and the sail can be made sliding along a girder or a rib and if desired equipped with a locking device, so that the point of support can be adjusted with regard to the sail.

Damages can be avoided or reduced if the handles or bows required for steering can hinge away from the mast. In order to maintain the proper position during steering, limiting means are applied to limit the turning angle towards the mast, executed for instance with bracing wires.

Since fixed steering devices such as handles or bows are used that are also capable in withstanding pressure forces, the mast can be omitted and the sailor can take over its functions. By also dispensing of deck and sailing-apparatus all connections between the sail and the surface over which the sailor wishes to move, are replaced by the sailor. For the purpose of transmitting reaction-forces such like for instance derived from the wind and weight-forces, to the carrying surface, the sailor can make use of for instance floaters with a fin mounted under his feet in case of moving over water, or skate-like structures for instance mounted under his feet in case of moving over ice, or structures with wheels for moving over other hard surfaces.

Other characteristics or details of the invention are described in the claims and in the following description of prefered embodiments of the invention.

Of a sailing-apparatus with a wing-type sail as described above, some samples are given in the following FIGS. 1 through 5. In all drawings the mast is marked with m, girders marked $l_1$, $l_2$, etc., ribs marked $r_1$, $r_2$, etc., bows for steering marked $b_1$, $b_2$, handles marked $h_1$, $h_2$, bracing-wire $s_1$, $s_2$, etc., the sail-cloth marked with zd.

FIGS. 1*a* and 1*b* show a wing-sail with a sail-cloth stretched between a front-girder $l_1$ and an end-girder $l_2$. The sail is put in the right profile by three ribs, $r_1$, $r_2$, $r_3$. By lifting the two ends of end girders $l_2$ slightly upwards, the profile of the sail turns slightly towards the tips of the sail. The sail is tightened by use of a wire running through eyes in the end-leech of the sail and around the end-girder, any other method of stretching the sail-cloth can be used. The front-girder is placed in the front-leech of the sail, in order to reduce the drag. Bows for steering are secured to the ribs $r_1$ and $r_3$ with hinges. The pins of the hinges of each bow are running in line with each other. Bracing wires $s_1$ and $s_2$ are holding the bows in position during sailing. In the example as shown in FIGS. 1*a* and 1*b*, the sail has a single cloth which can be secured to the ribs with the aid of a rope or canvas sewed to the sail such that a casing is formed fitting the rib. Examples of such constructions are given in the FIGS. 3 and 4*a* to 4*d*. Point of hinging is marked p on all drawings. Rotation of the sail is made possible by rotation of the top half of the coupling in its slot sl in such a manner that pulling forces are absorbed by a removable ring. Instead of a sleeve-bearing, for instance a ball-bearing or roller-bearing can be used.

Figure 2A:
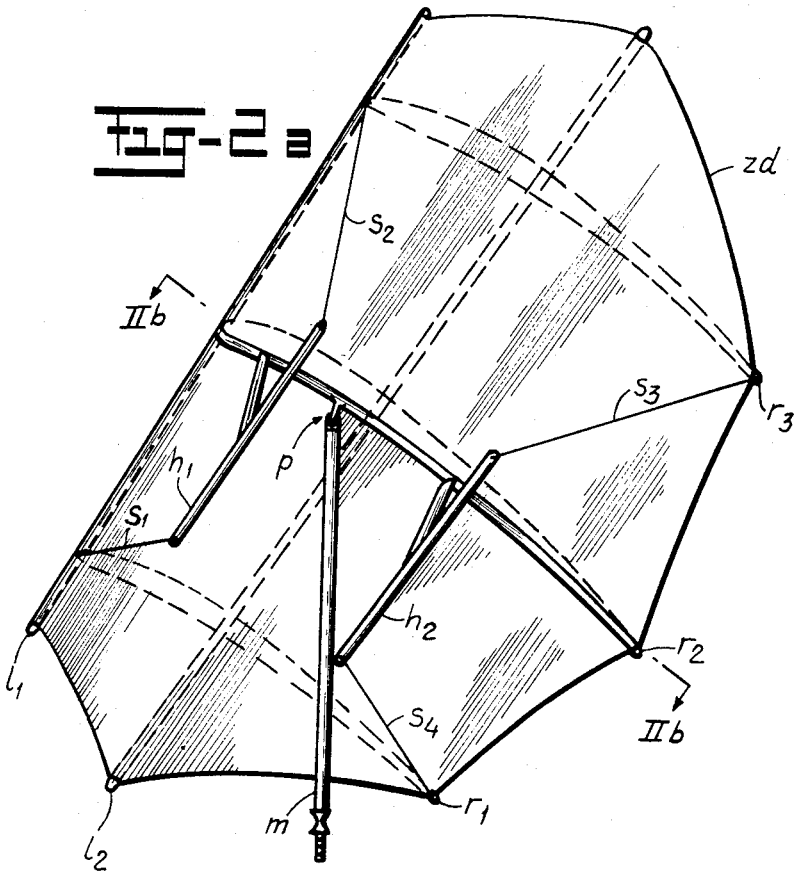
Figure 2B:
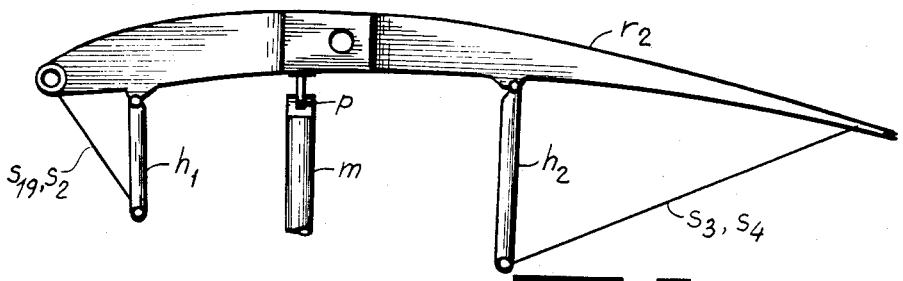
Figure 2C:
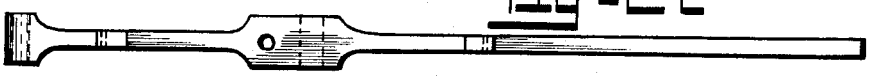

FIGS. 2*a*, 2*b* and 2*c* show a plan without an end-girder but with a main-girder instead, running through the entire span of the wing-sail. Tightening the sail-cloth can be arranged for instance by tightening a rope or wire which runs through the aft-leech of the sail over the ends of the girders and ribs. With this construction, a reduction of the drag is achieved. Here also a single or double cloth can be used. For steering two handles $h_1$ and $h_2$ are shown. A side-view of the middle-rib shows that the handles are mounted with hinges to the middle-rib. Bracing-wires ascertain that the handles can execute the required couple around the point of the resultant of the windforces, the sailor will pull the handles towards himself, so towards each other.

Figure 3:
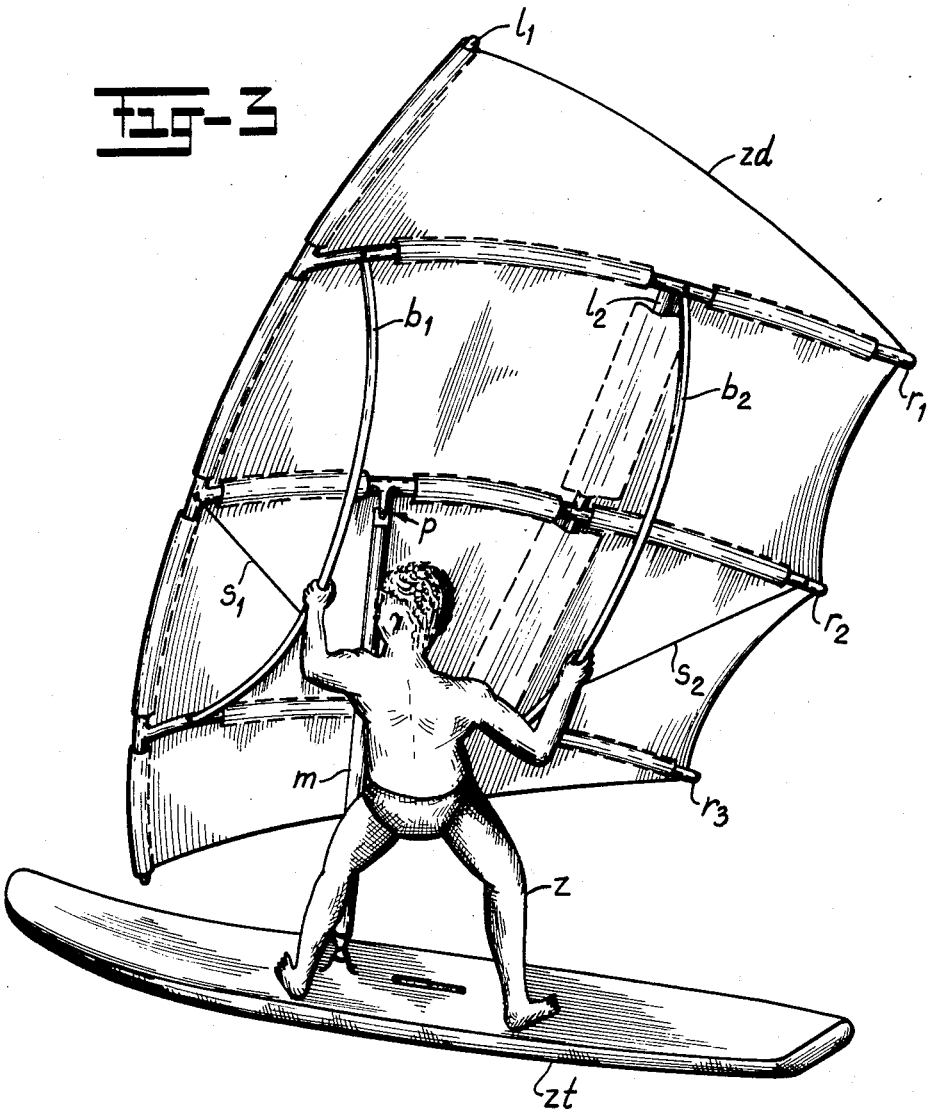

FIG. 3 shows a wing-sail with sailboard zt in action sailing close to the wind. In this plan the main-girder is simultaneously the front-girder, while a shorter girder maintains the distances between the ribs near the second and aftermost bow.

Figure 4A:
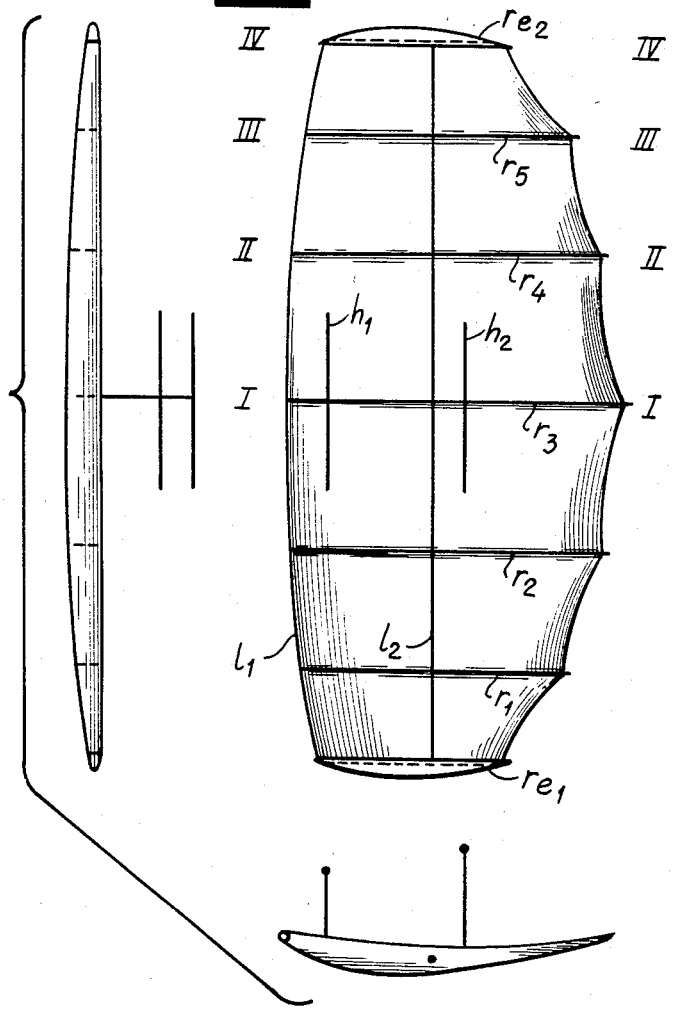
Figure 4B:
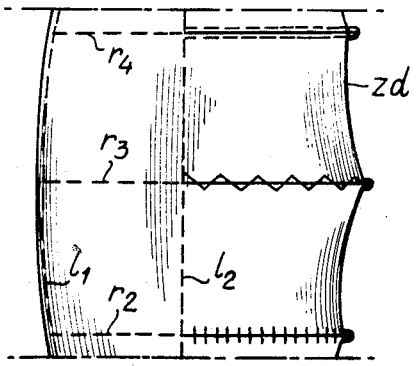
Figure 4C:
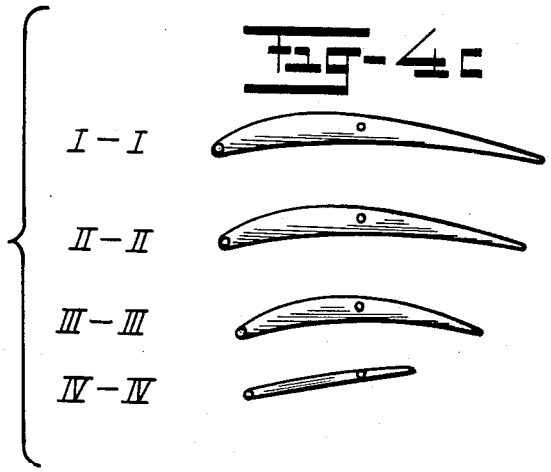
Figure 4D:
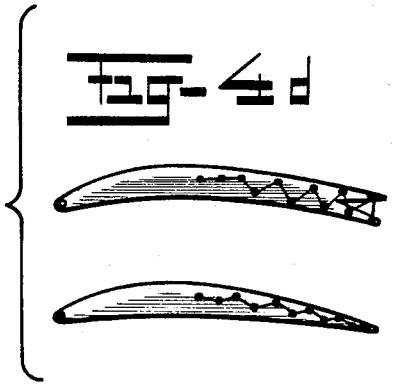

FIGS. 4*a* to 4*d* show in three views a more complex but also dismountable wing-sail. Ribs $r_{e1}$ and $r_{e2}$ at the tips of the sail are end-ribs, forming a sail-rim and connect the girders. The risk of damaging the sail is now reduced, it opens also the possibility of using a special end-profile. The shape of the profiled ribs is illustrated in FIG. 4*c*. The sail-cloth is double and tightened at the tips of the sail and along the aft-leech via the ends of the ribs. The ribs are locked in by cloth-profiles sewed to the sail. The sail-cloth is cut partially at one end so that the ribs can be inserted in their chambers, after which the chambers can be laced up, closed by hooks or closed in any other fashion, if required under a cloth cover to reduce the drag, see FIG. 4*b*. The possibility of an uninterrupted cloth does exist, the ribs are inserted in chambers for instance, made of cloth not tapered towards the opening, see FIG. 4*d*. For instance with a rope, wire or thread, with or without elasticity, the chambers can be closed. The main-girder is also inserted in a cloth-chamber as well as through openings in the ribs. The ribs are connected to the front-girder for instance with a pin. The end-ribs $r_{e1}$ and $r_{e2}$ are secured to the girders for instance with pins and screwed tight if so required. Subsequently the double cloth can be tightened between the end-ribs, along the ribs and along the aft-leech. Mast and bracing-wires are not shown in FIGS. 4*a* to 4*d*.

The Examples given are kept simple, V-shapes of the wing-sail, complex and composite profiles, tails, fins and steering-areas for instance are not shown. Many variations on the given examples are possible based on the same principle. For instance a reduction in the degrees of freedom can be accepted without effecting the advantages of this sail and rigging notably. For instance the angle between the mast and the sail can be secured in a chosen position.

In FIGS. 5*a* and 5*b* is given as example a bracing-wire sd running from one wing-half to the other through a bracing wire guides such as a locking-device k of a conventional structure situated in the mast m which can be activated or released with a motion of a foot or hand.

I claim:

1. A sail for propelling a sailing-apparatus over a surface, said sail having a frame, wherein sailing-cloth is tightened over said frame and whereby the underside comprises the windward side and the upperside comprises the leeside, and wherein the sail is rotatable and pivotable with the aid of steering means in all directions with respect to a supporting body, characterized in that said frame includes stiffening elements comprising girder means interconnected along the length thereof by rib means extending substantially perpendicular to said girder means, and means are provided for retaining said sailing cloth and said frame in tight proximate relationship for forming substantially stiff wing-type sail means having a design-pressure center of the wind forces acting on the sail when sailing said center lying in a reference axis substantially perpendicular to the longitudinal axis of said sail substantially along which, on the windward side of said sail, is defined a point of support for said frame, and in that said steering means to be controlled by a sailor are formed by a pair of stiff elongated handle means fitted to said frame and situated in a plane on the windward side of said sail substantially spaced from and parallel to the sail and distant from said point of support and said design-pressure center and distant at opposite sides of said point and center for adjusting the position of said point and said center relative to the sailing apparatus.

2. A sail according to claim 1, characterized in that the steering means are pivotally fitted at their ends to the frame and can be turned away from the supporting body, and limiting means (s) for limiting the turning angle of said steering means towards the body and for securing the position of said steering means during sailing are provided.

3. A sail according to claim 1 in combination with a mast, said mast comprising said supporting body, characterized in that said mast (m) is hingeable relative to the sailing-apparatus and means are provided on said frame substantially at said point of support and on said mast, for pivotally fitting said sail to the upper end of said mast.

4. A sail according to claim 1 in combination with a mast, said mast comprising said supporting body, characterized in that hinging means are provided in the point of support (p) and are at the one side adjustably fitted to a stiffening element and lockable in position along it and at the other side fitted to the top of said mast (m).

5. A sail according to claim 1 in combination with a mast, said mast comprising said supporting body characterized in that a bracing-wire (sd) is running from one side of said sail to the other via means in said mast (m) for guiding said bracing-wire.

6. A sail according to claim 1, characterized in that the sailing-apparatus is constituted by means for supporting a sailor on and for moving the sailor and said supporting means along a course consisting of one of a solid or of liquid surface under influence of wind acting on said sail.

7. A sail according to claim 1, in combination with a mast, said mast comprising said supporting body, said mast being supported at its lower end to the sailing apparatus and means are provided on said frame substantially at said point of support for said frame and on said mast for pivotally fitting said sail to the upper end of said mast.

* * * * *